US005174501A

United States Patent [19]

Hadar

[11] Patent Number: 5,174,501

[45] Date of Patent: Dec. 29, 1992

[54] GEAR DRIVE SPRINKLER

[75] Inventor: Yoram Hadar, Haifa, Israel

[73] Assignee: Lego M. Lemelshtrich Ltd., Natania, Israel

[21] Appl. No.: 801,131

[22] Filed: Dec. 2, 1991

[30] Foreign Application Priority Data

Dec. 5, 1990 [IL] Israel ..... 96546

[51] Int. Cl.[5] ..... B05B 3/16

[52] U.S. Cl. ..... 239/205; 239/206; 239/242; 239/201

[58] Field of Search ..... 239/200, 201, 205, 206, 239/237, 240-242, DIG. 1

[56] References Cited

U.S. PATENT DOCUMENTS

| | | | |
|---|---|---|---|
| 2,253,979 | 8/1941 | Lacy-Mulhall | 239/206 |
| 3,623,667 | 11/1971 | Costa | 239/240 |
| 3,934,820 | 1/1976 | Phaup | 239/206 |
| 4,417,691 | 11/1983 | Lockwood | 239/DIG. 1 |
| 4,925,098 | 5/1990 | DiPaola | 239/242 |

FOREIGN PATENT DOCUMENTS

| | | |
|---|---|---|
| 0384377 | 4/1908 | France . |
| 1196511 | 6/1970 | United Kingdom . |

*Primary Examiner*—Andres Kashnikow
*Assistant Examiner*—Karen B. Merritt
*Attorney, Agent, or Firm*—Benjamin J. Barish

[57] ABSTRACT

A gear drive sprinkler includes a fixed ring gear fixed to the sprinkler housing and having a circular array of teeth; a rotatable ring grear coupled to the sprinkler nozzle and having a circular array of teeth coaxial with, but of a different number than, the teeth of the fixed ring gear; and a planetary gear rotated by the sprinkler drive and having a circular array of teeth meshing with the teeth of both ring gears so as to planetate around both ring gears and thereby to rotate the rotatable ring gear at an angular velocity corresponding to the difference in the number of teeth in the two ring gears.

18 Claims, 5 Drawing Sheets

GEAR DRIVE SPRINKLER

FIELD AND BACKGROUND OF THE INVENTION

The present invention relates to rotary sprinklers, and particularly to the type of rotary sprinklers widely used for irrigating lawns, gardens, crops, etc.

One known type of rotary sprinkler used for irrigating lawns, gardens, crops, etc., includes a rotatable nozzle carried by a housing and a drive driven by the pressurized water and coupled to the nozzle via a transmission to rotate the nozzle. Such rotary sprinklers, when not used for long periods of time in lawns, open fields, etc., tend to become jammed against rotation by the entry of dirt and other foreign matter into the rotary mechanism, preventing the rotation of the nozzle. When a sprinkler thus becomes jammed, its nozzle discharges the water only to a small portion of the area to be irrigated, thereby leaving the remainder of the area dry. As a result, not only is there a large wastage of water, but also there can be a large loss in the crop yield. Moreover, such sprinklers require frequent maintenance in order to clear the jamming, which results in increased costs and longer down-time of the respective portion of the irrigation system.

OBJECTS AND BRIEF SUMMARY OF THE INVENTION

An object of the present invention is to provide a rotary sprinkler which utilizes the pressure of the supply water to rotate the sprinkler but which produces low angular velocity and a very large torque, thereby reducing the possibility of jamming of the sprinkler against rotation. Another object is to provide a rotary sprinkler constructed of relatively few simple parts which can be produced and assembled in volume and at low cost.

According to the present invention, there is provided a gear drive sprinkler including a housing assembly having an inlet connectible to a water supply pipe supplying pressurized water, a drive disposed within the housing assembly and rotatable by the pressurized water, a rotatable nozzle carried by the housing assembly, and a transmission coupling the rotatable nozzle to the drive; characterized in that the transmission comprises: a fixed ring gear fixed to the housing assembly and having a circular array of teeth; a rotatable ring gear coupled to the nozzle and having a circular array of teeth coaxial with, but of a different number than, the teeth of the fixed ring gear; and a planetary gear rotated by the drive and having a circular array of teeth meshing with the teeth of both the ring gears so as to planetate around both of the ring gears and thereby to rotate the rotatable ring gear at an angular velocity corresponding to the difference in the number of teeth in the two ring gears.

In the described preferred embodiment, the rotatable ring gear has one more (or less) tooth than the fixed ring gear. Also, the drive includes a turbine wheel having a plurality of turbine blades on its outer circumference.

According to one feature in the described preferred embodiments, the sprinkler further includes a spring-urged bypass valve normally closed to direct all the water to the drive but effective upon excessive pressure in the inletted pressurized water to cause inletted water to bypass the drive and thereby to flow directly to the nozzle.

According to another feature in the described preferred embodiments, the transmission further includes step-down gearing between the drive and the planetary gear.

According to still further features in the described preferred embodiments, the inlet to the housing assembly includes: a first inlet opening directing the water to flow in one direction to the drive to rotate the drive in the one direction; a second inlet opening directing the water to flow in the opposite direction to the drive to rotate the drive in the opposite direction; and a shutter actuatable to a first position to open the one inlet opening and to close the second inlet opening to thereby rotate the drive in one direction, or to a second position to open the second inlet opening and to close the first inlet opening to rotate the drive in the opposite direction.

A rotary sprinkler constructed in accordance with the foregoing features provides a very large torque, thereby decreasing the possibility of jamming of the sprinkler against rotation. It also utilizes a relatively few simple parts which can be produced and assembled in volume and at low cost.

Further features and advantages of the invention will be apparent from the description below.

BRIEF DESCRIPTION OF THE DRAWINGS

The invention is described herein, by way of example only, with reference to the accompanying drawings, wherein.

DESCRIPTION OF PREFERRED EMBODIMENTS

Figure 1:
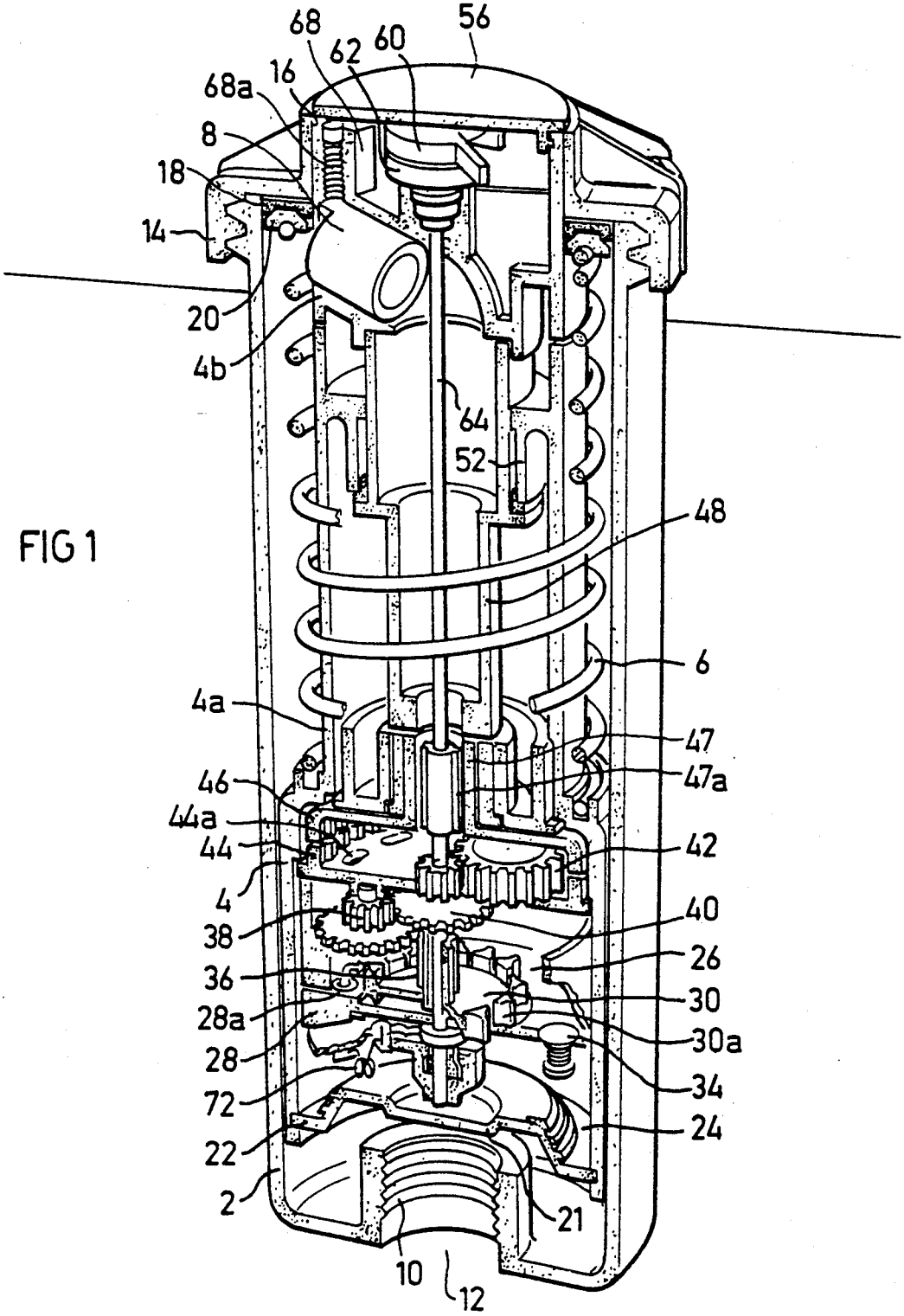
FIG. 1 is a three-dimensional view, partly broken away to show internal structure, illustrating one form of rotary sprinkler constructed in accordance with the present invention.

The rotary sprinkler illustrated in the drawings is of the sector, pop-up type, that is, one which waters only a predetermined sector, rather than a complete circle, around the sprinkler, and which includes a water discharge nozzle which is normally in a retracted position (e.g., under the ground), but which is automatically actuated to a pop-up position above the ground when pressurized water is supplied to the water sprinkler.

Figure 2:
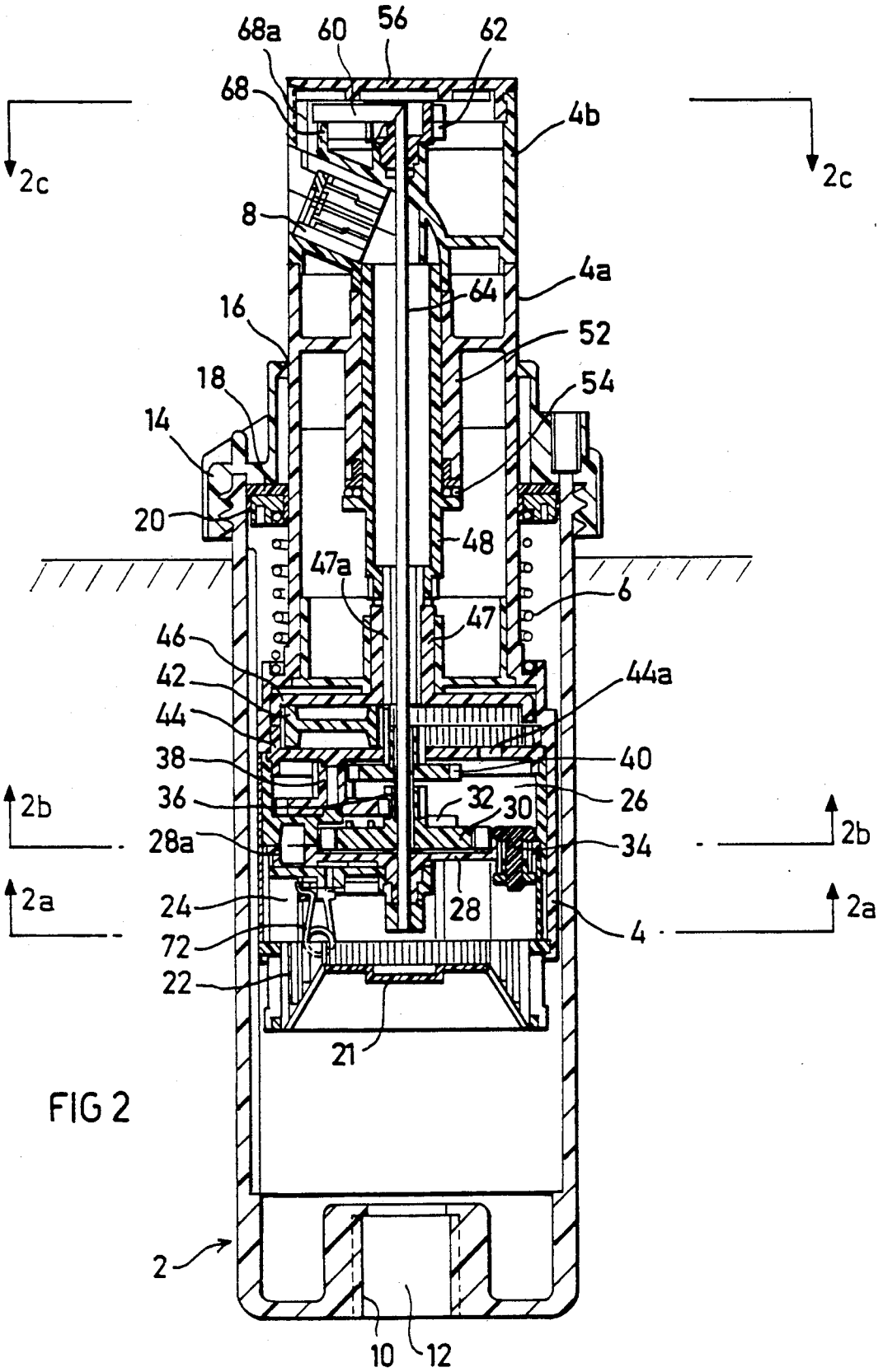
FIG. 2 is a longitudinal sectional view of the sprinkler of FIG. 1 in its pop-up position.

The sprinkler illustrated in the drawings comprises a housing assembly including an outer housing 2 and an inner housing 4. The inner housing is normally in a retracted position within the outer housing 2, as shown in FIG. 1, under the influence of a coil spring 6. Housing 4 includes a lower non-rotatable section 4*a* and an upper section 4*b* rotatable with respect to section 4*a*. The upper, rotatable section 4*b* carries a nozzle 8 which is also normally in a retracted position within the outer housing 2, as shown in FIG. 1, but which automatically is projected to a pop-up position, as shown in FIG. 2, when the sprinkler is connected to a supply of pressurized water.

The outer housing 2 is of cylindrical configuration. At its lower end, it is formed with internal threads 10 defining an inlet opening 12 connectible to a water supply pipe (not shown) supplying pressurized water to the sprinkler. The opposite end of housing 2 is closed by a threaded cap 14 formed with a central opening 16. Cap 14 further includes a seat for receiving a slidable seal 18 slidably engageable with the outer surface of the inner housing 4 for effecting a seal between the two housings. Seal 18 is pressed against cap 14 by a ring 20 and spring 6.

Figure 2A:
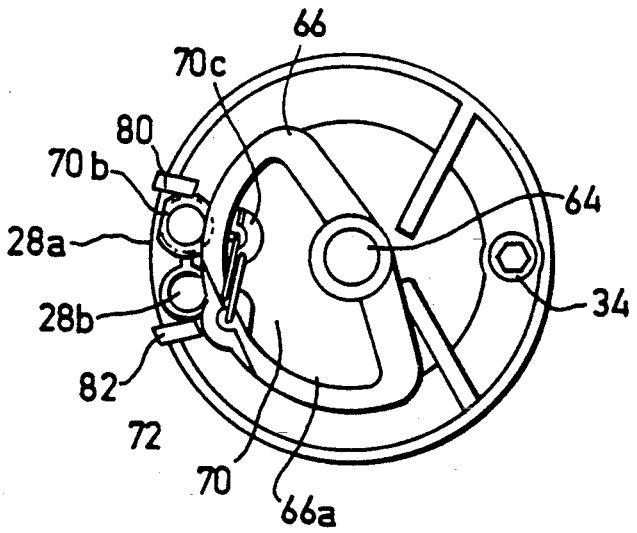
FIGS. 2*a*, 2*b* and 2*c* are sectional views along lines 2*a*—2*a*, 2*b*—2*b* and 2*c*—2*c*, respectively, of FIG. 2.

The inner housing 4 includes a cap 21 which closes the inlet in the retracted position of the housing. Housing 4 further includes a filter screen 22 at its inlet end, aligned with the inlet 12 of the outer housing 2, for removing foreign particles from the water before the water enters an inlet chamber 24. From the inlet chamber 24 the water may pass to a drive chamber 26 via one of two inlet openings 28*a*, 28*b* (as shown particularly in FIGS. 2*a* and 2*b*), formed in a partition wall 28 defining the two chambers. As will be described below, the water flows from inlet chamber 24 into drive chamber 26 via inlet opening 28*a* when the nozzle 8 is to be rotated in one direction, and via inlet opening 28*b* when the nozzle is to be rotated in the opposite direction.

Figure 2B:
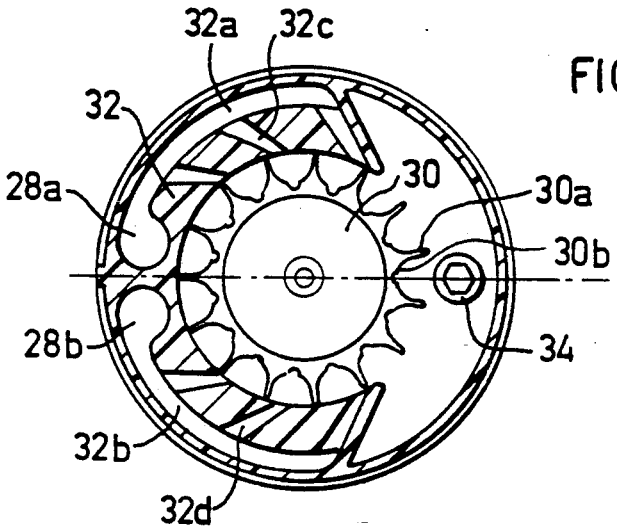

Drive chamber 26 includes a turbine wheel 30 formed with a plurality of turbine blades 30*a* on its outer circumference As shown particularly in FIG. 2*b*, the turbine wheel is partially enclosed by a sleeve 32, which may be integrally formed with the partition wall 28. Sleeve 32 is formed with two arcuate slots 32*a*, 32*b*, each communicating with one of the inlet openings 28*a*, 28*b*. Each of the slots 32*a*, 32*b* is further formed with a plurality of openings 32*c*, 32*d*, respectively, extending substantially tangential to the turbine wheel 30. Thus, the water inletted via opening 28*a* will be applied via openings 32*c* in one tangential direction with respect to the turbine wheel 30 to rotate it in one direction, whereas the water inletted via inlet opening 28*b* will be applied via openings 32*d* in the opposite tangential direction to rotate the turbine wheel in the opposite direction.

As further shown in FIG. 2*b*, the turbine blades 30*a* extend substantially radially of the turbine wheel 30, and are joined to the turbine wheel by substantially semi-circular bottom lands 30*b*. In addition, their width is larger than the thickness of the turbine wheel 30 as shown in FIG. 1. Such a construction has been found to produce a relatively large rotary torque.

Partition wall 28 dividing the inlet chamber 24 from the drive chamber 26 is also provided with a bypass valve 34. As shown in FIG. 1, valve 34 is normally spring-urged to a closed condition, but is opened to bypass the water from the turbine wheel 30 and to lead it directly into chamber 26 in case of an excessive inlet water pressure.

Turbine wheel 30 is coupled by a gear transmission to the rotatable section 4*b* of the inner housing 4 carrying the discharge nozzle 8 so as to rotate the nozzle by using the pressurized water which rotates the turbine wheel. The transmission between turbine wheel 30 and rotatable section 4*b* of the inner housing 4 includes gears 36, 38, 40, 42, 44 and 46. Gears 36, 38 and 40 are step-down gears, and gear 42 is a planetary gear having external teeth. Gear 44 is a fixed ring gear fixed to the non-rotatable section 4*a* of the inner housing 4, and is formed with internal teeth in a circular array around its circumference. Gear 46 is also a ring gear but is rotatably mounted with respect to the non-rotatable section 4*a* of housing 4 and is fixed to the rotatable section 4*b* carrying the nozzle 8.

The rotatable ring gear 46 also has a circular array of internal teeth which are coaxial with, but of a different number than, the teeth of the fixed ring gear 44. Planetary gear 42, rotated by the turbine wheel 30 via the step-down gearing 36, 38 and 40, has a circular array of teeth meshing with the teeth of both ring gears 44, 46, so as to planetate around both of those ring gears. It will thus be seen that the rotation of planetary gear 42 will rotate the rotatable ring gear 46 at an angular velocity corresponding to the difference in the number of teeth between ring gear 46 and the fixed ring gear 44.

As one example, the fixed ring gear 44 may have 66 teeth, and the rotatable ring gear 46 may have 67 teeth, so that the rotatable ring gear, and nozzle 8 coupled to it, will move the distance of one teeth for each complete orbit of planetary gear 42 around the fixed ring gear 44.

The rotatable ring gear 46 is integrally formed with a sleeve 47 coupled to another sleeve 48 extending centrally of the inner housing 4 and supporting the rotatable section 4*b* of the inner housing 4 carrying the nozzle 8. Thus, sleeve 48, housing section 4*b*, and nozzle 8 will also be rotated by the rotatable ring gear 46. The lower section 4*a* of the inner housing 4 does not rotate with nozzle 8. It includes a sleeve 52 enclosing sleeve 48 and sealed therefrom by an annular seal 54.

The fixed ring gear 44 is formed with a plurality of openings 44*a*. Sleeve 47 fixed to the rotatable ring gear is formed with a circular array of axial bores 47*a* serving as passageways for the flow of the water to the nozzle 8.

Figure 2C:
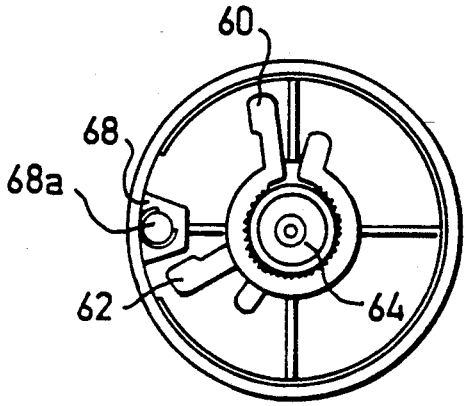

The rotatable housing section 4*b* carrying the nozzle 8 is closed at its upper end by a cover 56. Cover 56 is removable in order to provide access to a presettable mechanism for presetting the sector to be watered by the sprinkler, i.e., the sector of oscillations of nozzle 8. This presettable mechanism is more particularly illustrated in FIGS. 3 and 2*c*.

Figure 3:
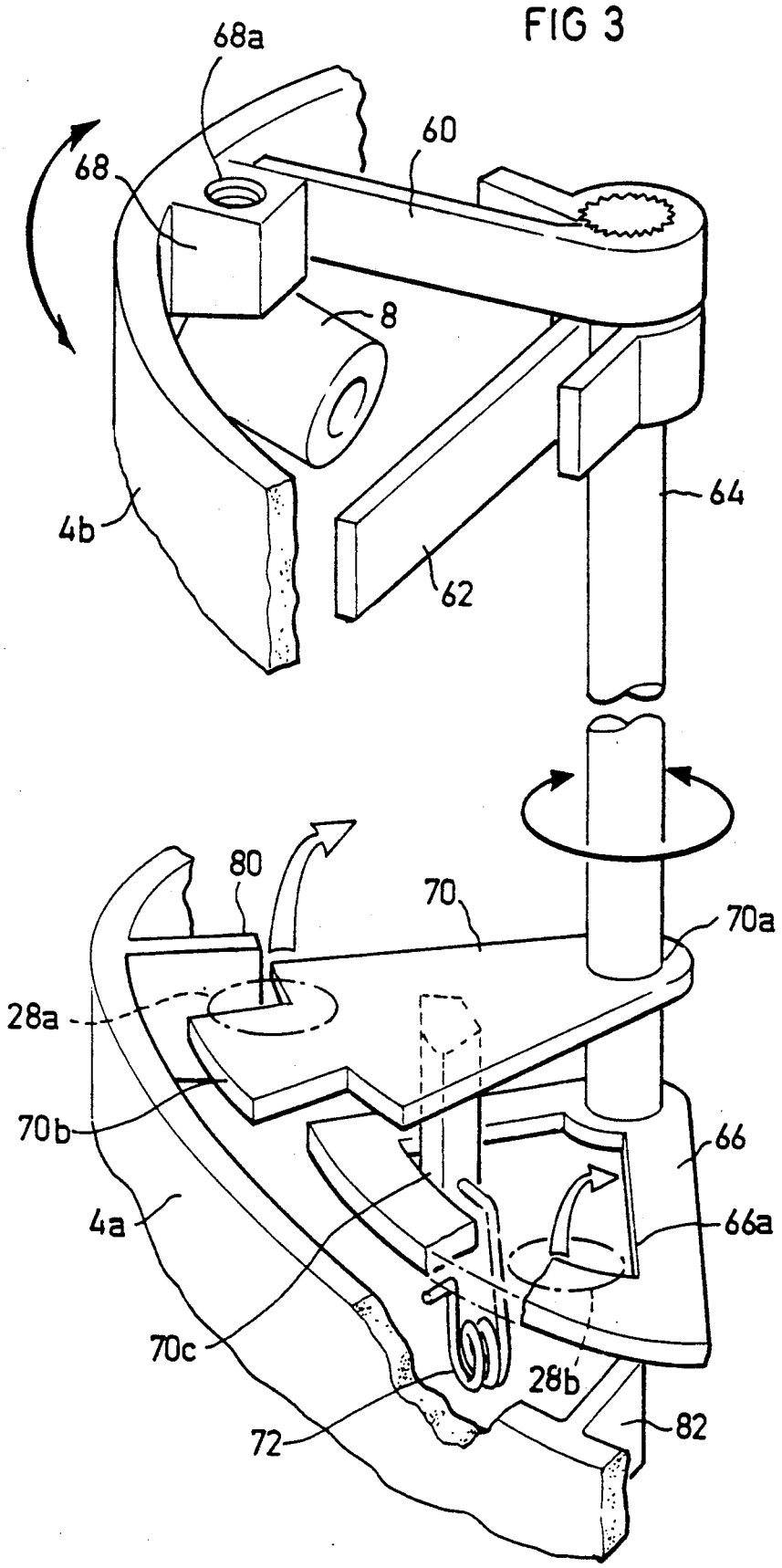
FIG. 3 more particularly illustrates the sector-defining mechanism included in the sprinkler of FIGS. 1 and 2.

Thus, as shown particularly in FIG. 3, the presettable mechanism includes two presettable stops 60, 62 which may be preset to any desired angular position on a central shaft 64 fixed at its lower end to an actuator member 66 disposed within the inlet chamber 24 of the non-rotatable section 4*a* of inner housing 4. The two presettable stops 60, 62 cooperate with an abutment 68 carried on the inner face of the rotatable section 4*b* of the inner housing 4. Abutment 68 is formed with an opening 68*a* for receiving a fastener (not shown) to fix the nozzle 8 to the rotatable housing section 4*b*.

The sector-defining mechanism further includes a shutter 70 actuatable to a first position (shown in FIG. 2*a*) uncovering inlet opening 28*b* and covering inlet opening 28*a*, or to a second position (not shown), wherein it would cover inlet opening 28*b* and uncover inlet opening 28*a*. Shutter 70 is actuated to either of these positions by a bi-stable mechanism, including actuator member 66.

Thus shutter 70 is formed at one end with an opening 70*a* freely mounting the shutter on shaft 64, and with an extension 70*b* at its opposite end adapted to cover inlet opening 28*a* in one position of the shutter, and inlet opening 28*b* in the other position of the shutter. The shutter 70 is further formed with a depending lug 70*c* receivable within a cut-out 66*a* formed in actuator member 66 fixed to the lower end of shaft 64. Lug 70*c* serves as a means for mounting one end of an over-center spring 72, the opposite end of the spring being mounted to the actuator member 66. The non-rotatable section 4*a* of the inner housing 4 includes two stops 80, 82 engageable with extension 70*b* of shutter 70 to limit its movement so that its extension 70*b* covers either opening 28*a* or 28*b*.

The rotary sprinkler illustrated in the drawings operates as follows:

First, the two presettable stops 60, 62 are preset by the user to determine the sector around the sprinkler that will be watered by the sprinkler.

The sprinkler is normally buried in the ground such that the upper end of its outer housing 2 is at, or just above, the soil line. When no pressurized water is applied to the sprinkler, the inner housing 4 will be in its retracted position within the outer housing 2, as shown in FIG. 1, under the influence of spring 6. As soon as pressurized water is supplied to the sprinkler via its inlet 12, the pressure of the water automatically moves the inner housing 4 to its pop-up position, as shown in FIG. 2, with its nozzle 8 above the soil line.

The pressurized water introduced via inlet 12 passes through filter screen 22 to remove solid particles and then enters the inlet chamber 24. From inlet chamber 24, the water may flow either via inlet opening 28*a*, or inlet opening 28*b*, depending on which is open by the shutter 70 (FIG. 2*a*) into the drive chamber 26 via the appropriate tangential passageways 32*c* or 32*d* (FIG. 2*b*) and the turbine wheel 30. Thus, if the water enters the drive chamber 26 via inlet opening 28*a*, it will rotate the turbine wheel clockwise as shown in FIG. 2*b*, and if it enters via inlet opening 28*b*, it will rotate the turbine wheel counterclockwise. From the drive chamber the water flows via openings 44*a* on the fixed ring gear, and the axial bores 47*a* on the sleeve 47 fixed to the rotatable ring gear, to the nozzle 8.

Turbine wheel 30 is coupled via step-down gears 36, 38 and 40, to rotate planetary gear 42 around the two ring gears 44 and 46. As noted above, ring gear 44 is fixed with respect to the non-rotatable section 4*a* of the inner housing 4, whereas ring gear 46 is rotatable; in addition, ring gear 46 includes a different number of teeth (in this case one tooth more) than the fixed gear 44. Accordingly, as gear 42 planetates around both of the ring gears 44, 46, ring gear 46 will rotate at an angular velocity corresponding to the difference in the number of teeth between the two ring gears.

The rotation of ring gear 46 is coupled via sleeve 48 to the upper rotatable section 4*b* of the inner housing 4, so that nozzle 8 carried by the rotatable section of the inner housing will rotate with respect to the lower, non-rotatable section 4*a* of the inner housing.

The rotatable section 4*b* of the inner housing 4, including nozzle 8, will thus rotate until abutment 68 (FIGS. 3 and 2*c*) on the rotatable section 4*b* of the housing engages one of the presettable stops 60, 62. Assuming the direction of rotation is such that it engages presettable stop 60, as soon as the abutment engages the stop, it increases its grip of shaft 64 and then starts to rotate the shaft, and thereby also actuator member 66 fixed to the lower end of the shaft. Actuator member 66 will therefore move (clockwise in FIG. 3) until it passes the axis of over-center spring 72, and when this occurs, it quickly snaps shutter 70, previously covering inlet opening 28*a*, to cover inlet opening 28*b*. This will cause the water to flow in the opposite direction tangentially to the turbine wheel 30, thereby reversing the direction of the rotation wheel, and the direction of rotation of the rotatable section 4*b* of the inner housing 4 together with the nozzle 8 carried by the housing.

If the inlet pressure is excessive, bypass valve 34 will open to permit inletted water to flow directly from the inlet chamber 24 to the drive chamber 26 bypassing the turbine wheel 30.

The construction illustrated in the drawings has been found to produce a large torque for rotating the sprinkler, thereby decreasing the possibility of the sprinkler becoming jammed against rotation.

Figure 4:
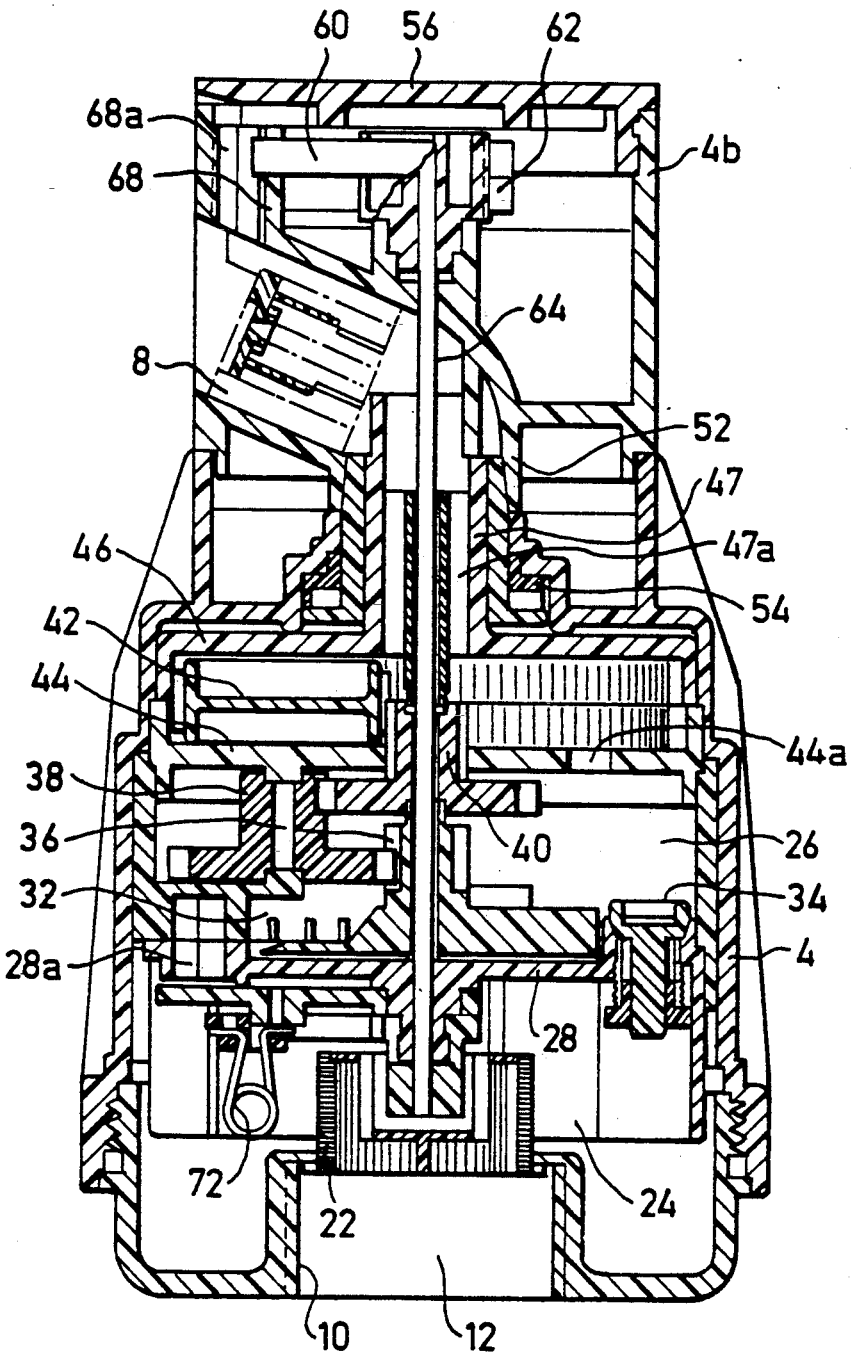
FIG. 4 illustrates a non-pop-up sprinkler constructed in accordance with the present invention.

FIG. 4 illustrates a non-pop-up sprinkler which is constructed, and operates in the same manner, as the sprinkler of FIGS. 1–3, except that the structural elements providing the pop-up feature have been omitted. The remaining elements of the sprinkler of FIG. 4 are substantially the same and have been identified with the same reference numerals as in FIGS. 1–3 to facilitate understanding.

While the invention has been described with respect to two preferred embodiments, it will be appreciated that many variations may be made.

What is claimed is:

1. A rotary sprinkler, including a housing assembly having an inlet connectible to a water supply pipe supplying pressurized water, a drive disposed within said housing assembly and rotatable by said pressurized water, a rotatable nozzle carried by said housing assembly, and a transmission coupling said rotatable nozzle to said drive; characterized in that said transmission comprises:

a fixed ring gear fixed to said housing assembly and having a circular array of teeth;

a rotatable ring gear coupled to said nozzle and having a circular array of teeth coaxial with, but of a different number than, the teeth of said fixed ring gear;

a planetary gear rotated by said drive and having a circular array of teeth meshing with the teeth of both said ring gears so as to planetate around both of said ring gears and thereby to rotate said rotatable ring gear at an angular velocity corresponding to the difference in the number of teeth in said two ring gears; and a spring-urged bypass valve normally closed to direct all the water to said drive but effective upon excessive pressure in the inletted pressurized water to cause inletted water to bypass said drive and thereby to flow directly to said nozzle.

2. The rotary sprinkler according to claim 1, wherein said drive includes a turbine wheel having a plurality of turbine blades on its outer circumference.

3. The rotary sprinkler according to claim 2, wherein said housing assembly includes a sleeve enclosing said turbine wheel and formed with a plurality of openings for directing the inletted water to impinge said turbine blades substantially tangential to said turbine wheel.

4. The rotary sprinkler according to claim 3, wherein said turbine blades extend substantially radially of said turbine wheel, and are joined to the turbine wheel by substantially semi-circular bottom lands.

5. The rotary sprinkler according to claim 1, wherein said transmission further includes step-down gearing between said drive and said planetary gear.

6. The rotary sprinkler according to claim 1, wherein said rotatable ring gear has one more tooth than said fixed ring gear.

7. A rotary sprinkler, including a housing assembly having an inlet connectible to a water supply pipe supplying pressurized water, a drive disposed within said housing assembly and rotatable by said pressurized water, a rotatable nozzle carried by said housing assembly, and a transmission coupling said rotatable nozzle to said drive; said transmission comprising:

a fixed ring gear fixed to said housing assembly and having a circular array of teeth;

a rotatable ring gear coupled to said nozzle and having a circular array of teeth coaxial with, but of a different number than, the teeth of said fixed ring gear;

and a planetary gear rotated by said drive and having a circular array of teeth meshing with the teeth of both said ring gears so as to planetate around both of said ring gears and thereby to rotate said rotatable ring gear at an angular velocity corresponding to the difference in the number of teeth in said two ring gears;

said inlet to the housing assembly including:

a first inlet opening directing the water to flow in one direction to said drive to rotate the drive in said one direction;

a second inlet opening directing the water to flow in the opposite direction to said drive to rotate the drive in said opposite direction;

and a shutter actuatable to a first position to open said one inlet opening and to close said second inlet opening to thereby rotate the drive in one direction, or to a second position to open the second inlet opening and to close the first inlet opening to rotate the drive in the opposite direction.

8. The rotary sprinkler according to claim 7, further including a presettable sector-defining mechanism for defining the sector of rotation of the nozzle before said shutter is actuated to change the direction of rotation of the nozzle.

9. The rotary sprinkler according to claim 8, wherein said presettable sector-defining mechanism comprises:

a central shaft fixed to said nozzle to rotate therewith;

a pair of presettable stops presettable to different angular positions on said central shaft to thereby preset said sector of rotation of the nozzle;

an abutment rotatable with said nozzle and engageable with said presettable stops;

an actuator fixed to said central shaft;

and a bistable coupling between said actuator and said shutter and effective to move said shutter from one position to its other position upon the engagement of said abutment with one of said stops to change the direction of rotation of said nozzle.

10. A rotary sprinkler, including a housing assembly having an inlet connectible to a water supply pipe supplying pressurized water, a drive disposed within said housing assembly and rotatable by said pressurized water, a rotatable nozzle carried by said housing assembly, and a transmission coupling said rotatable nozzle to said drive; said transmission comprising:

a fixed ring gear fixed to said housing assembly and having a circular array of teeth;

a rotatable ring gear coupled to said nozzle and having a circular array of teeth coaxial with, but of a different number than, the teeth of said fixed ring gear;

and a planetary gear rotated by said drive and having a circular array of teeth meshing with the teeth of both said ring gears so as to planetate around both of said ring gears and thereby to rotate said rotatable ring gear at an angular velocity corresponding to the difference in the number of teeth in said two ring gears;

said housing assembly including a lower non-rotatable section including said inlet and said drive, and an upper rotatable section carrying said nozzle.

11. The rotary sprinkler according to claim 10, wherein said housing assembly further includes:

an outer housing;

an inner housing carrying said non-rotatable and rotatable sections and movable to a retracted position within said outer housing, or to a pop-up position with its nozzle projecting from the upper end of said outer housing;

and a spring normally urging said inner housing to its retracted position.

12. A rotary sprinkler, comprising:

a housing assembly having an inlet connectible to a water supply pipe supplying pressurized water, a turbine wheel drive disposed within said housing assembly and rotatable by said pressurized water, a rotatable nozzle carried by said housing assembly, and a transmission coupling said rotatable nozzle to said drive;

said transmission comprising:

a fixed ring gear fixed to said housing assembly and having a circular array of teeth;

a rotatable ring gear coupled to said nozzle and having a circular array of teeth coaxial with, but of a different number than, the teeth of said fixed ring gear;

a planetary gear rotated by said drive and having a circular array of teeth meshing with the teeth of both said ring gears so as to planetate around both of said ring gears and thereby to rotate said rotatable ring gear at an angular velocity corresponding to the difference in the number of teeth in said two ring gears;

and a step-down gearing between said drive and said planetary gear.

13. The rotary sprinkler according to claim 12, further including a spring-urged bypass valve normally closed to direct all the water to said drive but effective upon excessive pressure in the inletted pressurized water to cause inletted water to bypass said drive and thereby to flow directly to said nozzle.

14. The rotary sprinkler according to claim 12, wherein said housing assembly includes a sleeve enclosing said turbine wheel and formed with a plurality of openings for directing the inletted water to impinge said turbine blades substantially tangential to said turbine wheel.

15. The rotary sprinkler according to claim 14, wherein said turbine blades extend substantially radially of said turbine wheel, and are joined to the turbine wheel by substantially semi-circular bottom lands.

16. The rotary sprinkler according to claim 12, wherein said rotatable ring gear has one more tooth than said fixed ring gear.

17. The rotary sprinkler according to claim 12, wherein said inlet to the housing assembly includes:

a first inlet opening directing the water to flow in one direction to said drive to rotate the drive in said one direction;

a second inlet opening directing the water to flow in the opposite direction to said drive to rotate the drive in said opposite direction;

and a shutter actuatable to a first position to open said one inlet opening and to close said second inlet opening to thereby rotate the drive in one direction, or to a second position to open the second inlet opening and to close the first inlet opening to rotate the drive in the opposite direction.

18. The rotary sprinkler according to claim 17, further including a presettable sector-defining mechanism for defining the sector of rotation of the nozzle before said shutter is actuated to change the direction of rotation of the nozzle.

* * * * *